United States Patent [19]

Rom et al.

[11] 4,019,331

[45] Apr. 26, 1977

[54] FORMATION OF LOAD-BEARING FOUNDATIONS BY LASER-BEAM IRRADIATION OF THE SOIL

[75] Inventors: Josef Rom, Haifa; Israel Alterman, Savyon; Joseph Schwartz, Haifa, all of Israel

[73] Assignees: Technion Research and Development Foundation Ltd., Haifa; Israel Alterman, Savyon, both of Israel; part interest to each

[22] Filed: Mar. 10, 1976

[21] Appl. No.: 665,394

Related U.S. Application Data

[63] Continuation-in-part of Ser. No. 645,415, Dec. 30, 1975.

[30] Foreign Application Priority Data

Dec. 30, 1974 Israel ..... 46361

[52] U.S. Cl. ..... 61/53.54; 61/36 A; 61/63; 299/11

[51] Int. Cl.[2] ..... E02D 7/00

[58] Field of Search ..... 61/35, 36 A, 53.54; 299/14, 11; 175/11, 16; 219/121 LM, 121 EM

[56] References Cited

UNITED STATES PATENTS

| | | | |
|---|---|---|---|
| 3,154,370 | 10/1964 | Johnson | 219/121 L |
| 3,539,221 | 11/1970 | Gladstone | 175/16 |
| 3,544,165 | 12/1970 | Snedden | 299/14 |
| 3,693,718 | 9/1972 | Stout | 175/16 |
| 3,693,731 | 9/1972 | Armstrong et al. | 175/11 |
| 3,807,182 | 4/1974 | Schnabel, Jr. | 61/35 |
| 3,871,485 | 3/1975 | Keenan, Jr. | 175/16 |
| 3,885,832 | 5/1975 | Altseimer et al. | 175/11 |

*Primary Examiner*—Paul R. Gilliam
*Assistant Examiner*—Alexander Grosz
*Attorney, Agent, or Firm*—Browdy and Neimark

[57] ABSTRACT

The method of converting clayey or silty soil into stable and solid underground columns or piles suitable for carrying a building structure, comprises first the drilling of bores of a diameter considerably smaller than the external diameter of the column or pile to be created, to a predetermined depth, and secondly directing a focused laser beam gradually across the entire surface of each bore by mechanical and optical means, in such a manner that each point of the bore surface is irradiated and heated at an intensity sufficient for converting the soil surrounding the bore into a solid permanent mass of a predetermined thickness measured from the bore surface, which mass retains its strength and is resistant to moisture and temperature.

9 Claims, 4 Drawing Figures

FORMATION OF LOAD-BEARING FOUNDATIONS BY LASER-BEAM IRRADIATION OF THE SOIL

FIELD OF THE INVENTION

This is a continuation-in-part application of copending application Ser. No. 645,415 filed Dec. 30, 1975.

The invention relates to the conversion of soil, more especially silt and clay, into load-bearing columns or piles by means of local irradiation by a laser beam.

BACKGROUND OF THE INVENTION

The erection of structures on soils with a low load-bearing capacity, such as clays and silts, requires either the transference of the load to more stable strata below or, in case such strata exist at too great a depth, the distribution of the load over a large volume of the soil in width as well as in depth, with the aim of reducing the specific load in all points of the soil and of preventing a detrimental settling of the foundation. In both cases the general practice is to drive or to cast into the soil piles of suitable dimensions and in a number sufficient for transferring the load of the structure to the soil.

Pile material — which formerly was exclusively wood — is today mostly concrete or corrosion-protected steel. Piles are either driven into the soil by pile hammers, or are cast in situ, in the form of cased or uncased concrete piles, in predetermined grouping and spacing, in a vertical and/or an inclined direction in order to take up vertical as well as horizontal loads.

Piles are effective in one of four ways: — the first, by transferring the load through soft upper strata to the end bearing on a hard substratum; the second, as friction piles in their lower portions, transferring the load through soft upper strata into stiffer strata below; the third, as pure friction piles over their full length; and the fourth which is met with occassionally, by compacting the soil.

With friction piles the load is taken up by the soil adjacent to the pile surface and distributed over a larger volume of soil. Paradoxically, the pile surface should be smooth while the pile is being driven into the soil, in order to offer a minimum of resistance to the driving force; but it should be as rough as possible when the pile is in place, so as to present a maximum friction coefficient between surface and soil.

Cast concrete piles generally possess a smooth surface, whether they are cast in steel tube casings or uncased in clay or silt. The result is that for a certain load to be supported and to be transferred to the soil a smooth pile of considerably greater length and diameter is required than would be necessary with a pile having a very rough surface.

With increasing spans, weight and height of building structures the loading of the supporting soil naturally increases and requires a larger number of piles of great length and diameter, especially in all those cases in which they act as friction piles, whether over their entire length or over only part of it. Piles and pile-boring and driving equipment together constitute a large item of the total building cost.

SUMMARY OF THE INVENTION

It is, accordingly, an object of the present invention to reduce these costs considerably by altogether dispensing with piles of foreign material and, instead, converting the soil itself into load-bearing columns or piles. It is a general object of the present invention to overcome the defects of the prior art; it is a further object to provide for improved load-bearing in construction; and it is another object to provide for the conversion of soil into hardened, load-bearable material.

It is well known that clay and silt can be converted into hard material such as bricks or pottery by burning, thereby expelling the water originally contained in the pores between the fine particles. It is also known that this process is irreversible, i.e. no amount of water can reconstitute burnt pottery to the original clayey earth. A most efficient method of converting the soil to a dense and rigid material, in accordance with the invention, is by irradiating it with a focused laser beam, which is particularly suited for this task owing to its high radiation power and the possibility of controlling its intensity and the resulting temperature and heat penetration in the irradiated soil.

The method of converting clayey or silty soil into stable and solid underground columns or piles suitable for carrying a building structure, comprises first the drilling of bores of a diameter considerably smaller than the external diameter of the column or pile to be created, to a predetermined depth, and secondly directing a focused laser beam gradually across the entire surface of each bore by mechanical and optical means, in such a manner that each point of the bore surface is irradiated and heated at an intensity sufficient for converting the soil surrounding the bore into a solid mass of a predetermined thickness measured from the bore surface.

In a preferred embodiment of the invention a laser beam emerging from a laser source is deflected into the bore with its path co-inciding with the bore axis, by means of an optical system comprising a first flat mirror and a concave mirror, and made to travel in a helical path over the entire bore surface by means of a second flat mirror placed obliquely in the path of the beam within the bore, which second flat mirror is adapted to be rotated about the bore axis and to be moved along it by suitable mechanical means known to the art.

In another embodiment a hollow cylindrical laser beam is created by a known unstable optical resonator and directed into the bore co-axially therewith. The laser beam is deflected towards the bore walls by a conical mirror placed concentrically with, and adapted to be moved along, the bore axis by suitable mechanical means known to the art. The optical system is preferably cooled by water or other means to enable it to withstand the radiation heat. In the case of unstable soils, a casing may be inserted in accordance with well-established practice, and then gradually withdrawn simultaneously with the raising of the optical system.

This method of irradiating the bore surface results in a hollow column or pile of fused soil particles, said column or pile having an irregular and very rough outer surface. This is caused by the inherent inhomogeneity of the soil, which results in differentiated water evaporation and in hardening in different directions along and around the bore with alternately deeper and shallower penetration and fusion actions. The roughness converts the normal friction between pile and soil into direct shear between soil masses. Accordingly, fewer, shorter and/or thinner piles or columns are required for certain structural load, than would be necessary if driven or cast piles were used.

An additional great saving in building costs is achieved, since the proposed method eliminates the need for pile material, and makes pile casting and driving equipment redundant.

BRIEF DESCRIPTION OF DRAWING

In the accompanying drawings which show, by way of example in diagrammatical form, four embodiments of the method used to irradiate the bore walls.

DETAILED DESCRIPTION OF EMBODIMENTS

Figure 1:
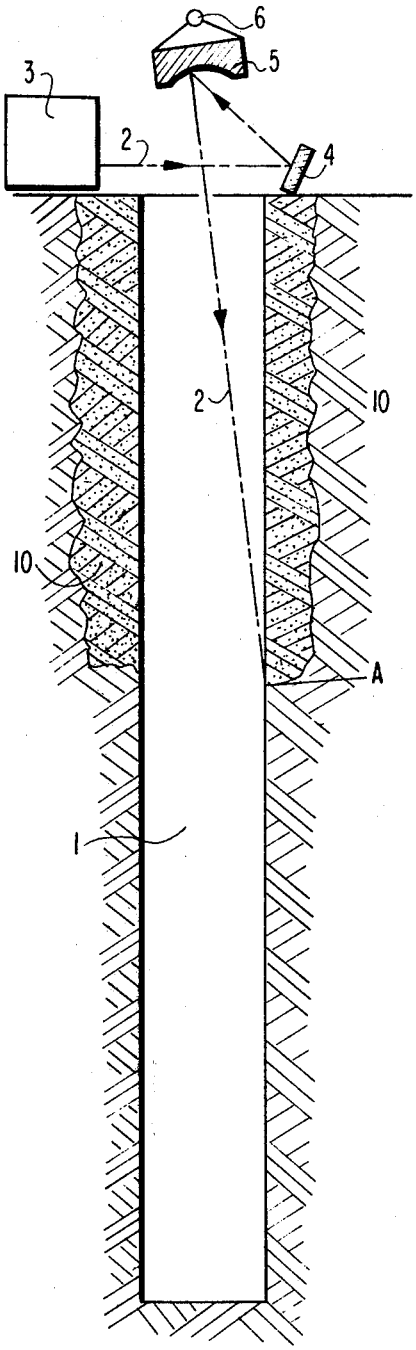
FIG. 1 is an apparatus for directing a laser beam towards the walls of a bore at an acute angle of incidence.

Referring now to FIG. 1 of the drawing a bore hole 1 drilled in the soil by conventional means is irradiated by a laser beam 2 emitted horizontally by a source 3. It is deflected from its course and directed towards the bore wall by means of a flat mirror 4 and a concave mirror 5 which is slowly rotated and at the same time angularly displaced about a spherical pivot 5 — thereby gradually changing the direction of the beam so as to irradiate the entire wall of the bore along a helical path. In FIG. 1 the helical path having started at the top of the bore, is seen to have reached a point A lower down. The soil surrounding the bore has been converted into a solid mass 10 down to point A, by the extreme heat produced by the laser beam which served to evaporate the water between the soil particles and to fuse the latter. Obviously the irradiation may be started at any point of the bore and irradiation may be accomplished in repeated passes.

FIG. 1 also indicates that the outer contours of the converted soil portion are not smooth but irregular as a consequence of the varying resistance of the soil against penetration of the radiation. The mechanism for providing the motion of the concave mirror is of the kind utilized in moving telescopes and is, therefore, not specially shown.

Figure 2:
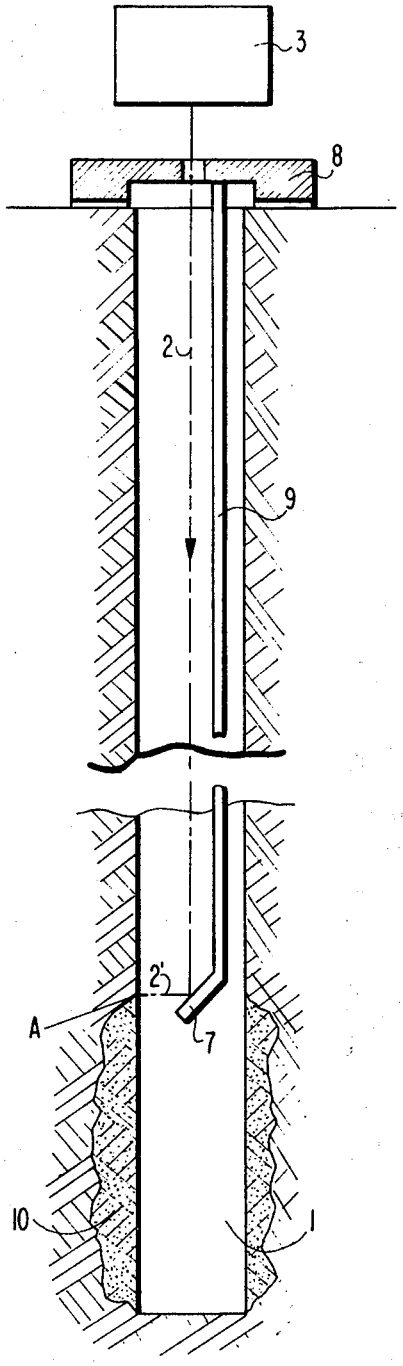
FIG. 2 is an apparatus using a rotatable and axially movable mirror for directing a laser beam to impinge perpendicularly onto the bore walls.

FIG. 2 shows a more exact method of directing the beam towards the bore hole wall, at a right angle of incidence. Herein a laser beam 2 emanates from a laser source 3 in a direction coaxial with the bore 1 and travels downwardly until it meets the surface of a mirror 7 which is positioned in the center of the bore while forming an angle of 45°with its axis. The mirror is attached by actuating and suspending means 9, to a mechanism 8 (both diagrammatically indicated) which rests on the rim of the bore hole and is adapted to rotate the mirror and to propel it in a constant axial motion along the bore. The laser beam is deflected by the mirror 7 from a vertical to a horizontal direction 2′ and is made to strike the bore wall at a right angle. The movement of the mirror serves to rotate the horizontal beam 2′ and at the same time to change its distance from ground level, whereby it describes a helical path on the bore hole wall. It can be seen that in the case illustrated, the mirror started from the bottom upwards to a point A, the soil around the bore hole having been converted to a hard column 10 from its lower end to this point.

Figure 3:
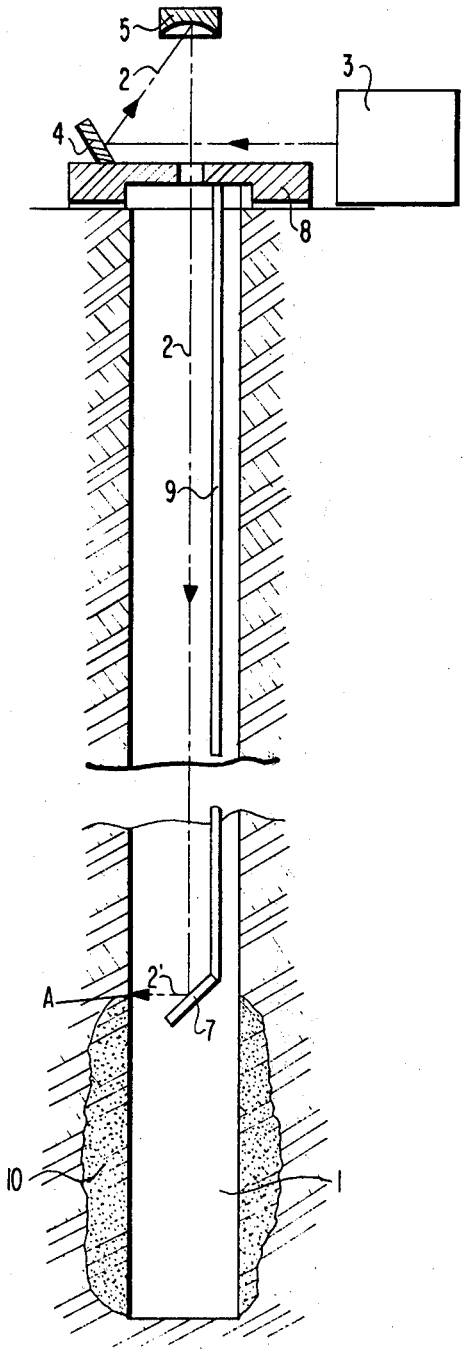
FIG. 3 is an apparatus similar to that illustrated in FIG. 2, but using a laser beam emerging from a source in horizontal direction and deflected into a vertical path by an optical system.

The apparatus shown in FIG. 3 is, in its underground portion, identical with that shown in FIG. 2. However, herein the laser beam emerges from a source 3 in a horizontal direction and is deflected into a vertical path coaxial with the bore by a flat, inclined mirror 4 and a concave mirror 5 placed above the bore concentric therewith. This mirror 5 also serves to concentrate the beam to a very small diameter so as to increase its local intensity. This arrangement is preferable to that illustrated in FIG. 2, in that it permits the adjustment of the laser path by means of easily movable mirrors, while the previously described apparatus of FIG. 2 requires the direct adjustment of the heavy laser source.

Figure 4:
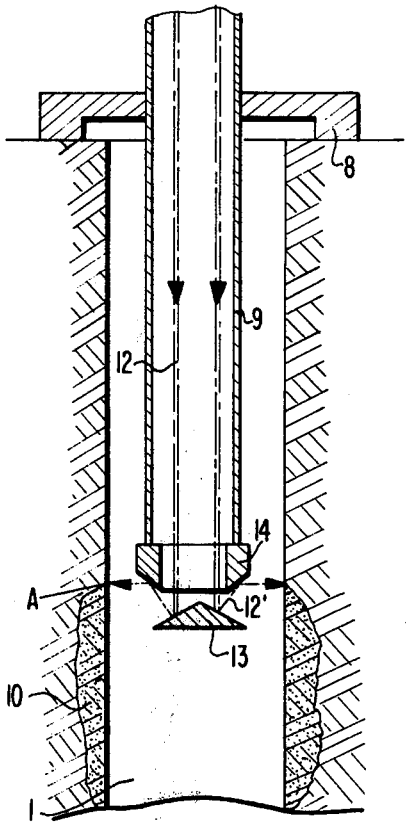
FIG. 4 is an apparatus using a hollow cylindrical laser beam directed towards the wall by a modified optical system.

The apparatus shown in FIG. 4 uses a hollow laser beam 12, which can be produced by an unstable optical resonator of known construction running coaxialy with the axis of the bore 1. The hollow laser beam is deflected and directed towards the bore circumference at a variable height A by an optical system comprising a conical mirror 13 and an annular mirror 14 in the shape of an inverted, straight or curved, frustum, The resulting radiation 12′ is in the shape of a horizontal disc of small thickness. Mechanical means 8 and 9 are provided for the purpose of moving the optical system in an upward or downward direction at a desired rate of progress; the support 9 in this case may be, as illustrated, a cylindrical tubing. It is evident that this apparatus calls for a laser source of much higher power than in the previously described embodiments, but this is compensated for by the shorter time required for completing a column.

After the formation of a group of underground columns or piles by one of the aforedescribed methods, a structure can be erected thereon in a conventional way.

The bores in the columns may be filled, if desired, such as with concrete, or they may preferably be left open and unfilled, since the strength of the converted soils is sufficient to carry the load. The void actually lessens the weight of the column or pile compared with a steel or concrete pile of the same capacity, and this saved weight may be usefully employed by allowing a corresponding additional weight of the structure to be loaded on each individual pile or column.

The optical and mechanical systems serving to direct a laser beam along and around the bore hole wall may be suitably modified, and any type of mirrors and lenses may be used in any combination in accordance with the state of the art.

The wave length of the laser beam is preferably in the infra-red region in which mostly thermic energy is produced. Suitable soil temperatures lie between 2000°and 3000° centigrade, but higher surface temperatures may be employed to obtain deeper penetration for the purpose of creating columns of greater thickness.

The type of laser used, the energy of the beam, its velocity of travel along the bore wall and spacing between adjoining helix paths will be chosen in accordance with the properties of the soil, its water contents and the size and load-bearing capacity of the column to be formed; these will be largely determined by simple, routine on-the-spot testing. However, in general a laser generator of 3–10 KW output is satisfactory for most situations, although higher outputs may be used for increased speed. The size of the bore is dependent on the mechanism to be inserted, and in this respect the method illustrated in FIG. 1 permits a smaller bore than the other methods.

It is further proposed to utilize a stationary laser source for the irradiation of a plurality of bore holes, by successively or simultaneously deflecting the path of the laser beam into the desired direction and location by means of movable and adjustable mirrors.

In order to save energy, it may be advantageous to pump out or evaporate excessive moisture in the soil. Evaporation may be accomplished by means of a gas or plasma flame, and electron beam, or other suitable means. Such evaporation may not, however, itself result in fusing of the soil.

It shall be understood that fusing of the soil using direct heating means cannot be used in place of the laser beam. Any such attempt to use direct heat other than a laser, e.g. a flame, from inside the bore would at least result in the formation of a "skin" which would prevent or at least greatly impede the fusing of the soil behind the skin. Only the laser beam is capable of simultaneously heating the entire depth of soil so that it fuses and consolidates to form the desired load-bearing foundation. On the other hand, suitable means to provide inductive or dielectric heating could be used.

It will be obvious to those skilled in the art that various changes may be made without departing from the scope of the invention and the invention is not to be considered limited to what is shown in the drawings and described in the specification.

What is claimed is:

1. A method of converting clayey or silty soil into a stable and solid underground column or pile suitable for supporting a building structure, which comprises drilling into the earth to a predetermined depth a bore hole of a diameter considerably smaller than the external diameter of the column or pile to be created, directing a focused laser beam gradually across the entire surface of said bore, in such a manner that each point of the bore surface is irradiated and heated at an intensity sufficient for converting the soil surrounding the bore into a solid mass of a predetermined thickness measured from the bore surface.

2. A method of converting clayey or silty soil into a stable and solid underground column as claimed in claim 1 wherein a laser beam traveling in a path coaxial with the bore hole is deflected towards the bore wall by means of a mirror obliquely positioned in the path of the beam inside the bore and rotated and at the same time moved along the bore axis so as to cause the laser beam to travel over the entire surface.

3. A method as claimed in claim 2 wherein the mirror is cooled.

4. A method of converting clayey or silty soil into a stable and solid underground column as claimed in claim 1 wherein a laser beam is deflected towards the bore wall by a concave mirror positioned in the axis of, and above the bore hole, and said mirror is slowly rotated about the beam axis and is angularly displaced about a spherical pivot so as to change the angle of incidence with the wall surface.

5. A method of converting clayey or silty soil into a stable and solid underground column as claimed in claim 1 wherein a laser beam generated in the shape of a hollow cylinder and directed into the bore co-axial therewith is deflected towards the wall of the bore by a conical mirror positioned concentrical with and moved along the bore axis.

6. A method of converting clayey or silty soil into a stable and solid underground column as claimed in claim 1 wherein a laser beam generated in the shape of a cylinder is deflected towards the bore wall by an optical system comprising a conical mirror positioned concentrical with the axis of the laser beam and an annular mirror in the shape of an inverted frustrum.

7. A method in accordance with claim 1 wherein said focused laser beam is gradually moved upwardly from the bottom of the bore hole to the top thereof.

8. A method in accordance with claim 7 wherein, after said bore hole is drilled, a tubular element is inserted into said bore hole, and wherein said tubular element is gradually withdrawn simultaneously with the movement of the laser beam across the entire surface of said bore from the bottom of said bore to the top thereof.

9. A load bearing underground column formed of fused earth in situ by the process of claim 1.

* * * * *